US005516081A

United States Patent [19]

Mourer

[11] Patent Number: 5,516,081

[45] Date of Patent: May 14, 1996

[54] WATER-COOLED MOLTEN METAL REFINING HEARTH

[75] Inventor: David P. Mourer, Beverly, Mass.

[73] Assignee: General Electric Company, Cincinnati, Ohio

[21] Appl. No.: 276,368

[22] Filed: Jul. 18, 1994

[51] Int. Cl.[6] ..... C21C 7/00

[52] U.S. Cl. ..... 266/233; 266/236; 266/241; 266/275

[58] Field of Search ..... 266/200, 204, 266/208, 166, 236, 233, 241, 275; 75/483, 584, 583, 708; 222/590, 594

[56] References Cited

U.S. PATENT DOCUMENTS

| | | | |
|---|---|---|---|
| 3,343,828 | 9/1967 | Hunt | 266/233 |
| 4,027,722 | 6/1977 | Hunt | 266/208 |
| 4,053,146 | 10/1977 | Smartt et al. | 266/216 |
| 4,741,463 | 5/1988 | Muller et al. | 266/204 |
| 5,147,451 | 9/1992 | Leland | 75/620 |

*Primary Examiner*—Scott Kastler
*Attorney, Agent, or Firm*—Andrew C. Hess; David L. Narciso

[57] ABSTRACT

An apparatus for producing a molten metal flow comprises a refining hearth having a water-cooled wall, and an entry flow channel through the wall of the hearth disposed tangentially to the wall such that a flow of molten metal introduced into the hearth through the entry flow channel flows tangentially to the wall of the hearth. The hearth further has an exit flow channel through the wall of the hearth disposed tangentially to the wall. The molten metal entering the refining hearth flows in a vortex pattern, aiding in the removal of solid particulate matter from the metal. The refining hearth may be agitated by an induction coil placed adjacent to the hearth. The exit flow may be through a number of adjacent exit flow channels to reduce its local velocity.

17 Claims, 5 Drawing Sheets

WATER-COOLED MOLTEN METAL REFINING HEARTH

BACKGROUND OF THE INVENTION

This invention relates to melt processes for the production of metal ingots, powders, and articles made therefrom, and, more particularly, to the design of a water-cooled refining hearth that aids in the removal of solid foreign matter from the metal.

An increasingly important method for the fabrication of metallic articles for critical applications is powder processing. In one approach, fine powder particles of the metallic alloy of interest are first formed. The proper quantity of the particles is placed into a mold or container and compacted by hot or cold isostatic pressing, extrusion, or other means. In another approach, the final product can be produced to virtually its final shape, so that little or no final machining is required, by depositing a fine spray of the metallic alloy onto a substrate to gradually build up an ingot or article. These powder metallurgical approaches have the important advantage that the microstructure of the product is typically finer and more uniform than that produced by conventional techniques.

The prerequisite to the use of powder fabrication technology is the ability to produce a "clean" powder of the required alloy composition and quality on a commercial scale. (The term "clean" refers to a low level of particles of foreign matter in the metal.) Numerous techniques have been devised for clean powder production. In the melt atomization process, a melt of the alloy of interest is formed, and a continuous stream of the alloy is produced from the melt. The stream is atomized into a fine spray by a gas jet or a spinning disk. Where metal powders are to be produced, the resulting droplets solidify during flight into particles that are collected and graded for size. Particles that meet the size specifications are retained, and those that do not are recycled through the system for remelting and reprocessing. Where an ingot is to be gradually built up, the droplets are deposited upon a substrate to form the ingot which is then further processed.

For some applications the amount of solid foreign matter in the melt must be minimized. The use of water-cooled ("cold") metallic hearths to melt the metallic alloy avoids the introduction of foreign matter such as ceramic particles into the melt. However, when the metallic alloy is melted in a water-cooled hearth, there is typically some amount of oxide or other solid foreign matter present in and on the surface of the melt. This solid matter may be oxide formed by the reaction of the metal with oxygen in the atmosphere, ceramic entrained in the melt in prior processing operations, compounds, or other matter. Some or all of the solid foreign matter may be swept along with the melt into the atomization apparatus, resulting in the inclusion of the foreign matter in the metal spray produced by atomization. The foreign matter is processed into the final articles along with the metal, and incorporated into the articles.

The presence of the foreign matter is usually deleterious to the properties of the final articles produced by this technique. The foreign matter can either initiate cracks or assist their propagation, leading to premature failure of the article. Since the foreign matter cannot be readily removed from the powder mix or the articles, it is important to prevent the foreign matter from being incorporated into the final articles.

There are two possible approaches to preventing foreign matter from entering the final articles. One is to prevent the introduction of the foreign matter into the metal entirely, and the other is to remove the foreign matter after it is present.

Conventional practice achieves a good degree of cleanliness, but it is unrealistic to expect that all foreign matter can be excluded from the metallic alloy at early stages of its production. Commercial melters follow the best cleanliness practices available, but inevitably oxides form on the surface of the melt and other foreign matter finds its way into the melt. The present invention therefore focuses on removing the solid foreign matter from the melt in a refining system prior to introduction of the melt into the atomization process.

Various techniques such as filtering the melt have been utilized in the past to remove solid foreign matter from the melt, but they have not been entirely successful. There is therefore a need for improvements to the techniques for removing solid foreign matter from melts prior to the atomization process. The present invention fulfills this need, and further provides related advantages.

SUMMARY OF THE INVENTION

The present invention provides techniques for controlling the flow of liquid metal in water-cooled hearths to aid in the removal of solid foreign matter from the melts and to improve the flow of molten metal from the hearth. The invention can be practiced with existing melting facilities, simply by replacing existing hearths with those of the present design. The present hearths are no more expensive than existing hearths. They perform the same functions as existing hearths, and additionally provide improved refining of the molten metal by aiding in the removal of solid foreign matter and improved control of the flow of refined molten metal leaving the hearth.

In accordance with the invention, apparatus for producing a molten metal flow comprises a refining hearth having a water-cooled wall, and an entry flow channel through the wall of the hearth disposed at an angle which is not perpendicular to the wall, such that a flow of molten metal into the hearth is not directed toward the center of the hearth. The hearth is preferably circular in plan view, and the entry flow channel is oriented so that the flow of molten metal into the hearth is directed tangential to the wall of the hearth. The molten metal flow therefore follows a whirlpool or vortex path in the hearth. This whirlpool pattern aids in separating any solid foreign matter that may be present from the molten metal, by accumulation, flotation, sinking, or other mechanism. The refined molten metal is removed from the hearth through an exit flow channel, which is preferably also tangential to the wall of the hearth.

Some of the solid foreign matter can be removed from the melt by dissolution, if the residence time of the foreign matter is sufficiently long in the melt and there is sufficient agitation. To increase the permitted depth of the hearth and the agitation in the hearth, the molten metal in the hearth can be stirred and heated by induction. In accordance with this aspect of the invention, apparatus for producing a molten metal flow comprises a refining hearth having a water-cooled wall, means for introducing metal into the refining hearth and for removing molten metal from the refining hearth, and an induction coil disposed adjacent to the refining hearth to agitate the contents of the hearth. The agitation, residence time, and pool size within the hearth may cause some foreign matter to dissolve into the melt, removing it as a problem in the final article.

This approach can be used with a single hearth, but also with two or more hearths connected "in series" so that molten met al flows from one hearth to the next. The whirlpool flows of metal in the several hearths can be selected to provide various combinations of flow patterns selected to remove different types of solid foreign matter and to cumulatively remove additional foreign matter with each succeeding hearth.

When molten metal exits the last hearth and enters an atomizer or an ingot collar, it introduces a thermal gradient into the atomizer or ingot collar, and may be flowing at a high flow rate that disturbs the metal already there. In accordance with another aspect of the invention, apparatus for producing a molten metal flow comprises a cooled hearth for holding a molten metallic alloy, the hearth having a hearth wall with cooling channels extending therethrough. The hearth further includes means for transferring a flow of the melted alloy from the hearth, the means for transferring including at least two adjacent exit flow channels through the hearth wall disposed so that molten metallic alloy controllably flows therethrough. The use of at least two, and preferably a plurality of, molten metal exit flow channels reduces the thermal gradient and also reduces the momentum transfer of the molten metal flow at a single location, spreading both thermal and mass flow effects out so that they are less pronounced.

The present approach results in improved quality of the product that is produced by the cold-hearth melting process. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

A preferred application of the apparatus for controlling the flow of a metal stream is in a metal powder production facility. The apparatus for controlling the flow of a metal stream may be used in other applications, such as, for example, a metal ingot production facility. The metal powder production facility is the presently preferred application, and is described so that the structure and operation of the invention can be fully understood.

Figure 1:
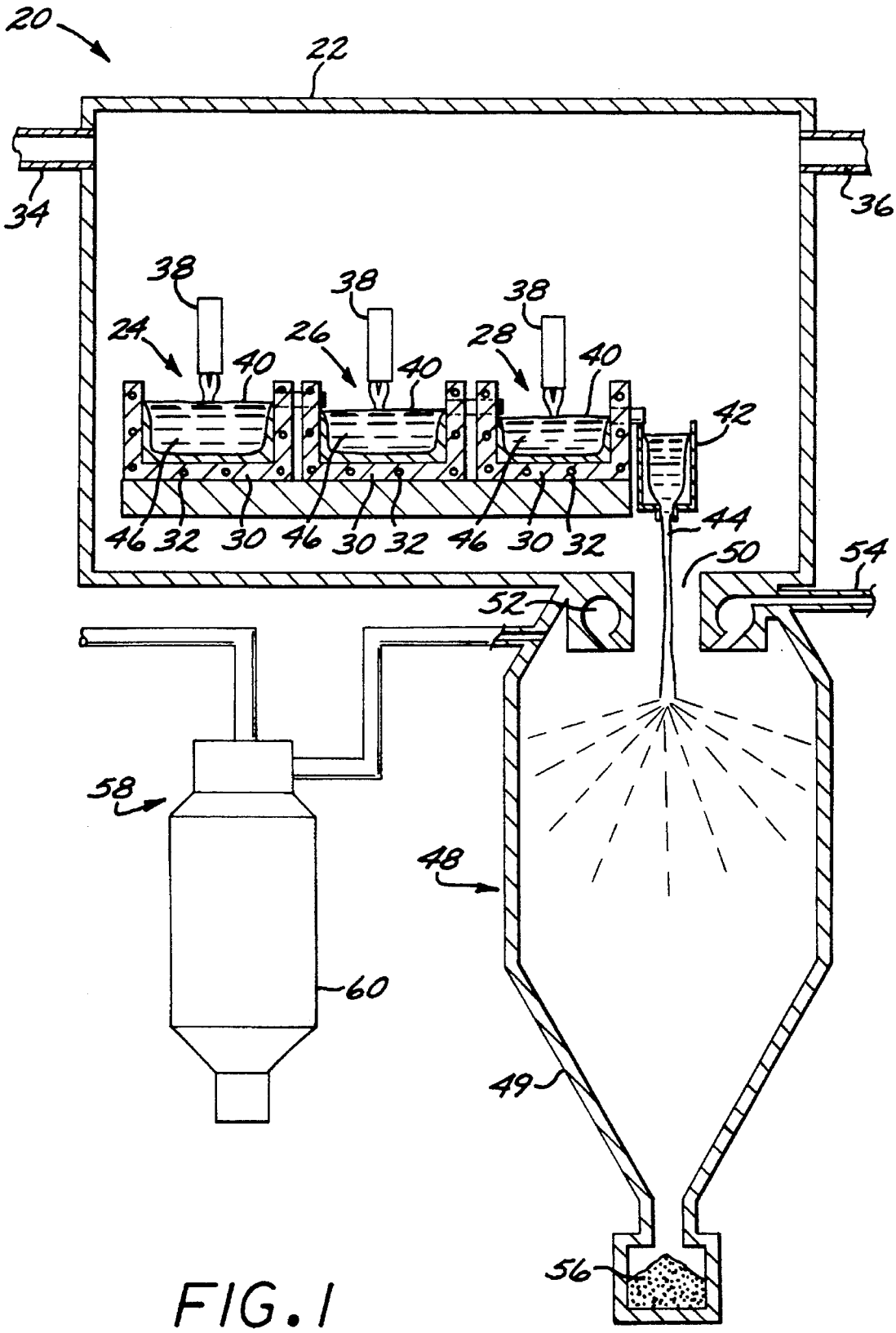
FIG. 1 is a sectional view of an apparatus for producing a refined metal stream.

An apparatus 20 for producing a stream of metal spray or particles is illustrated in FIG. 1. A similar apparatus having many of the same general features is discussed further in published UK Patent Application 2,142,046A. The disclosure of this reference does not include the refining hearths of the present invention.

A melting chamber 22 contains three fluid-cooled refining hearths 24, 26, and 28, each of the hearths including walls 30 having fluid-cooling passages 32 therein connected with a source of cooling fluid such as water (not shown). As used herein, the term "wall" or "walls" may include the base or floor as well as the side walls, as desired, of the member being described. The melting chamber 22 can be adapted to enclose a desired atmosphere or pressure condition, as for example by introducing an inert gas such as argon into an inlet 34, to be evacuated through a gas outlet 36. Disposed above each refining hearth 24, 26, 28 is a surface heating source directed toward the hearth, such as an illustrated plasma heat source 38 shown in the drawing as a plurality of plasma torches. With a metallic material 40 introduced into the hearths 24, 25, 28, the plasma heat source 38 is adapted to initiate and further the melting of such materials. When movable, the plasma heat source 38 is adapted to sweep over a surface of the metallic melt.

Metal is introduced into the first hearth 24, preferably as molten metal from a source (not shown), or as pieces of solid metal. The molten metal 40 flows (driven by gravity) from the first hearth 24 to the second hearth 26, and then to the third hearth 28. Three hearths are shown in this view, but fewer or more hearths could be utilized, depending upon the refining requirements. A virtue of the present invention is that it permits the use of as few or as many refining hearths as may be necessary and controllable. The molten metal 40 eventually leaves the hearth 28 and enters a stream control device such as the illustrated molten metal trough 42. A stream 44 of molten metal flows from the trough 42.

With cooling fluid such as water circulating within the cooling passages 32, the surface heat source such as a battery of movable plasma heat torches 38 is placed in operation. In this embodiment, the torches are moved to sweep a surface of the molten metal 40 in the hearths to melt (or keep molten) such material. As molten material contacts the cooled inner wall of the hearth, the molten material resolidifies into a hearth skull 46 which acts as a barrier or buffer between the hearth walls and other melted material and alloy in the hearth. In this way, solid foreign matter from the hearth walls cannot enter into the molten alloy within the hearth.

The stream 44 of molten metal can be used in several different ways, including production of metal powder (as illustrated in FIG. 1) or casting into an ingot, for example. A metal powder producer 48 can be of a variety of types well known in the art, for example atomization or other disintegration type devices which produce metal powders. FIG. 1 shows diagrammatically one of the gas atomization type which includes a cooling tower 49 having a molten metal inlet 50 about which is disposed an atomizing gas spray means 52 to inject atomizing gas such as argon, nitrogen, helium etc., into the molten metal stream 44 entering the cooling tower 49 through the inlet 50. Such an atomizing gas is fed through the conduit 54 from a pressurized gas source (not shown). The atomizing gas thus introduced into the molten alloy stream causes the stream to disperse into small particles which solidify and fall to the bottom of the cooling tower 49 to be collected in metal powder collector 56. Equivalently, atomization of the metal stream can be accomplished by impinging the stream against a spinning disk that causes the stream to disintegrate. As shown in FIG. 1, it is convenient to include with such a powder metal producer an exhaust system shown at 58. Generally, the exhaust system includes a fines or dust collector 60, for example of the cyclone collector type well known in the art.

The present invention is concerned with the details of the design of the refining hearths 24, 26, and 28, as discussed subsequently. The various embodiments can be used in conjunction with each other, as appropriate, and with the number and type of refining hearths required for particular applications.

Figure 2:
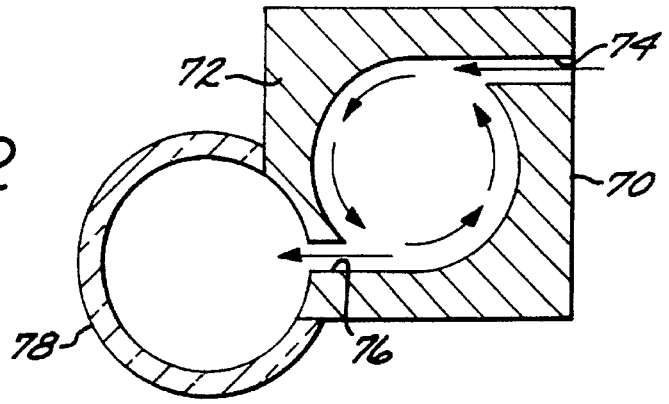
FIG. 2 is a plan view of a refining hearth with a tangential entry flow channel.

FIG. 2 is a plan view of a single refining hearth 70 having a water-cooled wall 72. In this preferred case, the wall 72 defines a substantially circular internal volume to the hearth 70. Molten metal flows into the refining hearth 70 through an entry flow channel 74 and out of the refining hearth 70 through an exit flow channel 76, and into a metal trough or ingot collar 78. The entry flow channel is disposed at an angle which is not perpendicular to the wall 72, so that the molten metal that flows into the refining hearth 70 is not directed toward the center of the hearth. Preferentially, the entry flow channel 74 is tangential to the wall 72 of the refining hearth 70, so that the molten metal introduced into the hearth 70 initially flows tangentially to the wall 72.

The circular or whirlpool flow of metal aids in refining the metal, particularly in removing solid foreign matter from the metal, by several mechanisms. Foreign matter has a greater time and circulation in the hearth than in cases where the melt is essentially stationary. Foreign matter having a density less than that of the melt is more likely to float to particular regions of the surface for collection by skimming, and in some instances tends to collect in the center of the whirlpool. Foreign matter having a density greater than that of the melt is more likely to be captured in the whirlpool and retained in the bottom center of the hearth. Foreign matter that can be redissolved in the melt is more likely to do so because of the increased stirring and residence time in the hearth.

The exit flow channel 75 preferably, though not necessarily, leaves the refining hearth 70 tangentially. In the single-hearth embodiment of FIG. 2, the entry flow channel 74 introduces the flow of metal tangentially to the wall 72 of the refining hearth 70, in the particular illustration in the counterclockwise direction. The exit flow channel 76 is oriented so that this counterclockwise flow does not sweep directly into the exit flow channel 76. Instead, movement of metal into the exit flow channel 76 requires that the metal reverse its flow direction to the clockwise direction. This reversal leads to a relatively slow flow velocity of the metal that leaves the refining hearth 70.

Figure 3:
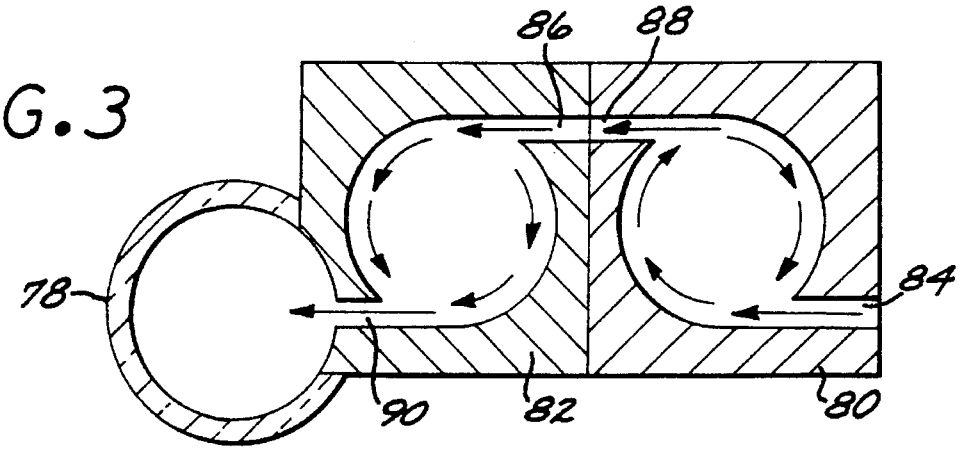
FIG. 3 is a plan view of two refining hearths arranged so that the flow rate of metal from the one hearth to the other hearth is relatively low.
Figure 4:
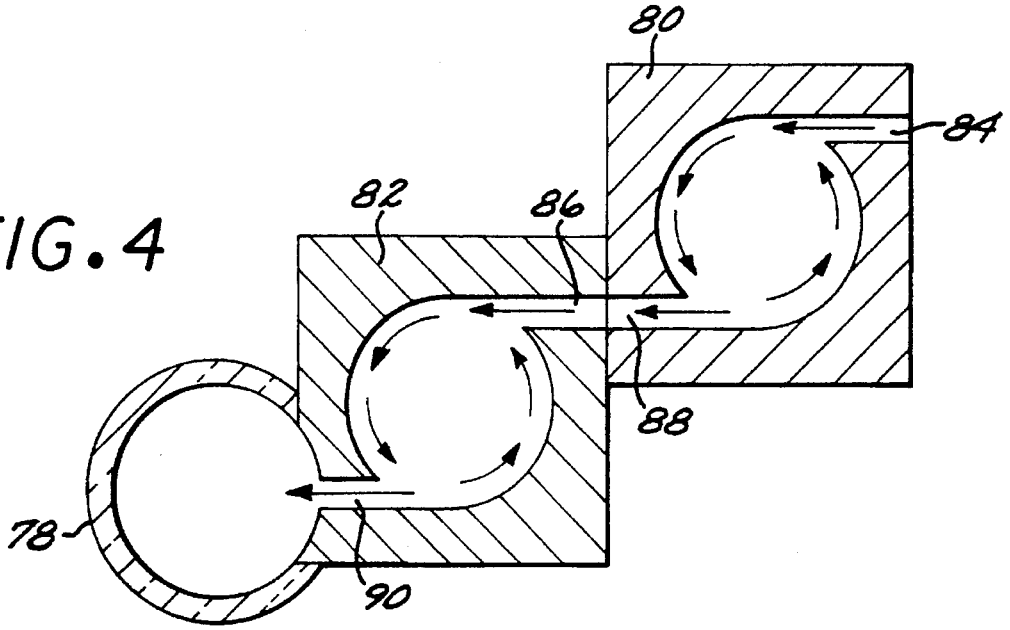
FIG. 4 is a plan view of another embodiment of two refining hearths arranged so that the flow rate of metal from the one hearth to the other hearth is relatively low.

FIGS. 3 and 4 show the use of two refining hearths arranged "in series" so that the metal flows from a first refining hearth 80 to a second refining hearth 82, and thence to the ingot collar 78. In each case, a first entry flow channel 84 is tangential to the wall of the first refining hearth 80, and a second entry flow channel 86 is tangential to the wall of the second refining hearth 82. In each case, an exit flow channel 88, 90 is tangential to the wall of the respective refining hearth 80, 82, and is arranged so that the metal flow must reverse its path to flow out of the hearth, in the manner described previously.

Figure 5:
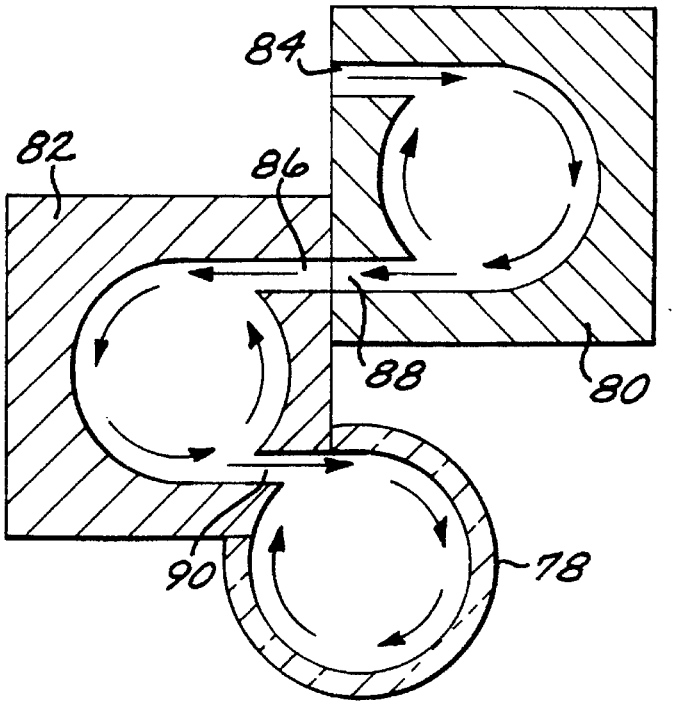
FIG. 5 is a plan view of two refining hearths arranged so that the flow rate of metal from one hearth to the other hearth is relatively fast.

FIG. 5 depicts a similar arrangement of two hearths 80 and 82. (The same numbering scheme is used for FIG. 5 as for FIGS. 3 and 4.) Here, however, the exit flow channel 88 of the first refining hearth 80 is positioned so that the metal flow out of the hearth 80 is in the same direction as the direction of introduction. The result is that the metal flow entering the second hearth entry flow channel 86 is faster than produced by the arrangement of FIGS. 3–4. For some refining operations, the greater entry flow rate into the second hearth 82 may be desirable.

The various arrangements of the entry and exit channels may be mixed together as needed.

Figure 6:
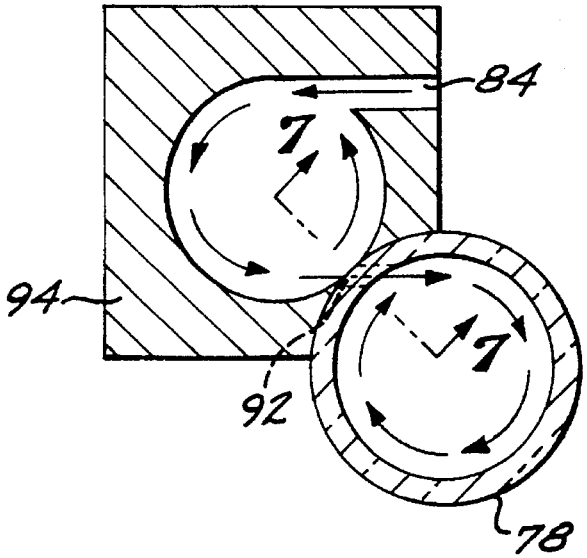
FIG. 6 is a plan view of a refining hearth with a subsurface exit flow channel.
Figure 7:
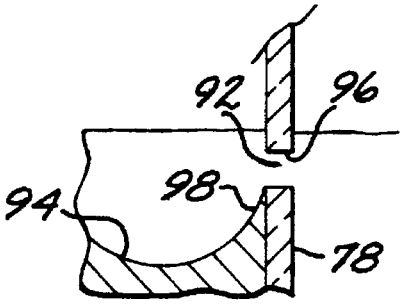
FIG. 7 is a partial sectional view of the refining hearth of FIG. 6, taken along lines 7—7.

In the views of FIGS. 2–5, the exit flow channel 90 from the second hearth 82 is a surface channel, with sides and a bottom defined by the walls of the hearth 82. In another embodiment depicted in FIGS. 6–7, a subsurface exit flow channel 92 from a hearth 94 is in the form of an aperture 96 having sides, a bottom, and a top defined by a wall 98 of the hearth 94 or the ingot collar 78.

When the molten metal leaves the refining hearth through a single exit flow channel such as those depicted in FIGS. 2–7, it may have a substantial velocity and typically introduces a turbulence into the metal in the trough 42 or the ingot collar 78. Also, it maintains a substantial thermal gradient in the metal of the trough 42 or the ingot collar 78. The velocity and thermal gradient can be reduced, if desired, by diffusing the momentum and temperature impact of the flow of metal.

Figure 8:
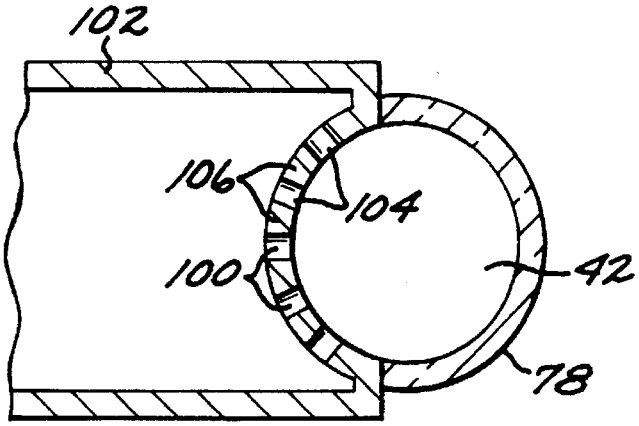
FIG. 8 is a plan view of a refining hearth with multiple adjacent exit flow channels.
Figure 9:
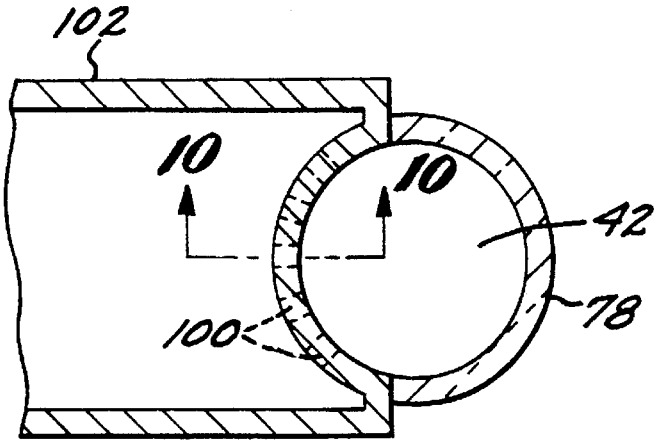
FIG. 9 is a plan view of a refining hearth with multiple adjacent subsurface exit flow channels.
Figure 10:
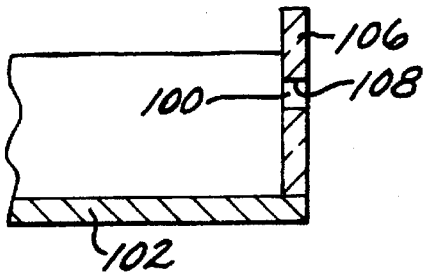
FIG. 10 is a partial sectional view of the refining hearth of FIG. 9, taken along lines 10—10.

To reduce the local velocity and momentum of the flow of metal, and the local temperature gradient created when the metal flow enters a pool of cooler metal, the metal flow is passed through at least two, and preferably a plurality of, exit flow channels 100 from a refining hearth 102. The exit flow channels 100 may be notches 104 extending downwardly from an upper margin of a wall 106 of the hearth 102, as shown in FIG. 8, or apertures 108 through the wall 106, as shown in FIGS. 9–10. A notch 104 prevents solid foreign matter which is more dense than the molten metal, and thence resides at the bottom of the hearth 102, from flowing through the exit flow channel 100. An aperture 108 prevents both more dense solid foreign matter and less dense, floating foreign matter from passing through the exit flow channel 100.

Figure 11:
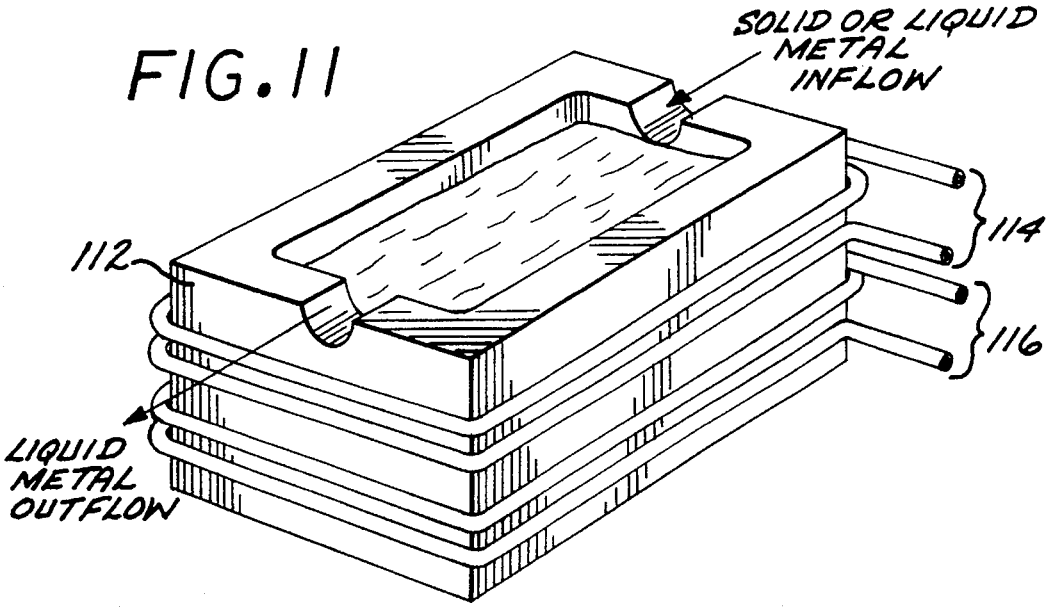
FIG. 11 is a perspective view of a refining hearth with induction agitation.
Figure 12:
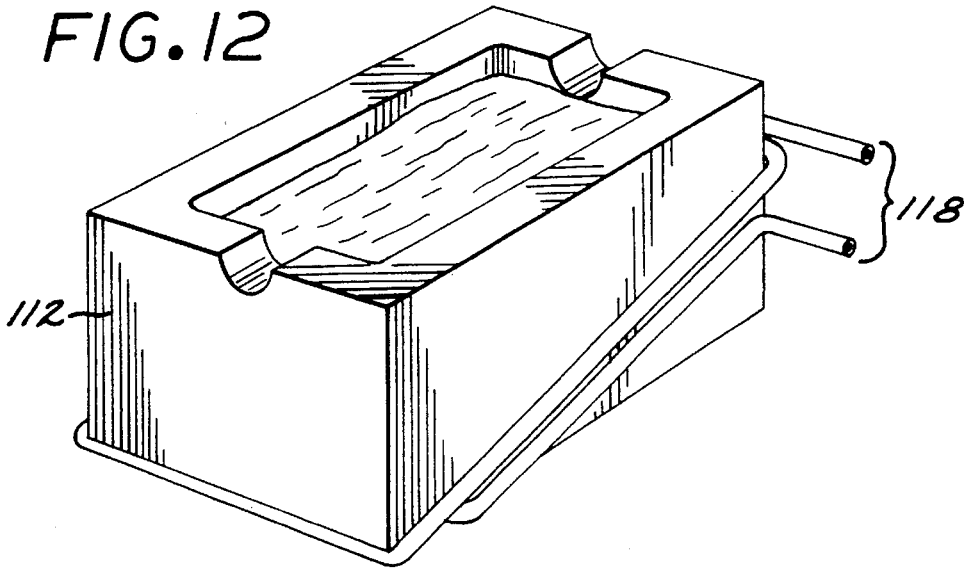
FIG. 12 is a perspective view of a refining hearth with inclined induction coils.

Another approach to improving the removal of solid foreign matter in a refining hearth is shown in FIGS. 11–12. The molten metal in a hearth 112 is heated by the passage of a high frequency alternating current through an induction coil 114 positioned adjacent to the hearth 112, and in particular coiled around the hearth 112. The induction coil is preferably excited by an AC voltage of about 300 KHz or higher. The field induced in the molten metal within the hearth 112 heats the metal, and also strongly agitates it. The agitation is particularly useful in causing solid foreign matter that is difficultly soluble in the molten metal to dissolve, thereby reducing the amount of solid foreign matter in the molten metal.

In a variation of this approach, also illustrated in FIG. 11, a second induction coil 116 can be wound about the hearth 112. The induction coils 114 and 115 can be connected so that they instantaneously apply forces in different directions to shear the metallic melt and apply an even more violent stirring action than achieved with a single induction coil.

Yet another embodiment is illustrated in FIG. 12. Here, a single induction coil 118 is wound about the hearth 112 (or two induction coils as shown in FIG. 11 could be used). The induction coil 118 is angled so that it induces a flow of metal between the bottom and the top of the melt within the refining hearth 112. This circulatory flow permits the interior of the hearth 112 to be deeper and hold more material than would otherwise be the case. The larger hearth in turn provides a longer mean residence time for dissolution of foreign matter.

In a typical refining operation as depicted in FIG. 1, the various embodiments of the invention can be used together for optimal results. For example, the first refining hearth 24 and the second refining hearth 26 may be the solid-matter separation hearths such as the hearths shown in FIGS. 3–5. The third refining hearth 28 may be an induction-heated hearth such as that of FIGS. 11–12. The final exit flow channel from the third refining hearth 28 to the molten metal trough 42 may have the multichannel arrangement of FIGS. 8–10. The result of this cooperative hearth arrangement is a reduction in the solid foreign matter that can enter the powder or ingot processing downstream of the hearths.

This Invention has been described in connection with specific embodiments and examples. However, it will be readily recognized by those skilled in the art the various modifications and variations of which the present invention is capable without departing from its scope as represented by the appended claims.

What is claimed is:

1. Apparatus for producing a molten metal flow, comprising:

a refining hearth having a water-cooled wall and a bottom, the bottom lying parallel to a base plane and the water-cooled wall being perpendicular to the base plane;

an entry flow channel through the wall of the refining hearth disposed at an angle which is not perpendicular to the wall such that a flow of molten metal into the refining hearth is directed tangential to the wall of the refining hearth and parallel to the base plane;

an exit flow channel through the wall of the refining hearth, the exit flow channel lying parallel to the base plane; and a second refining hearth adjacent to the refining hearth and having a second refining hearth water-cooled wall, the second refining hearth having a second refining hearth entry flow channel lying parallel to the base plane and disposed to receive a second flow of molten metal from the exit flow channel of the refining hearth and to direct the second flow of molten metal into the second refining hearth parallel to the base plane and tangential to the second refining hearth water-cooled wall.

2. The apparatus of claim 1, wherein the entry flow channel is an aperture through the refining hearth wall.

3. The apparatus of claim 1, wherein the entry flow channel has channel sides and a channel bottom defined by the wall of the refining hearth, but no top.

4. The apparatus of claim 1, wherein the refining hearth is substantially circular when viewed in a plan view.

5. The apparatus of claim 1, wherein the exit flow channel is tangential to the wall of the refining hearth.

6. The apparatus of claim 1, wherein the exit flow channel is an aperture through the refining hearth wall.

7. The apparatus of claim 1, wherein the exit flow channel has channel sides and a channel bottom defined by the wall of the refining hearth, but no top.

8. The apparatus of claim 1, wherein the second refining hearth has a second refining hearth exit flow channel, and wherein the apparatus further includes a third refining hearth adjacent to the second refining hearth, the third refining hearth having a third refining hearth entry flow channel disposed to receive a flow of molten metal from the second exit flow channel of the second refining hearth.

9. Apparatus for producing a molten metal flow, comprising:

a refining hearth having a water-cooled wall and a bottom, the bottom lying parallel to a base plane and the water-cooled wall being perpendicular to the base plane;

an entry flow channel through and tangential to the wall of the refining hearth such that a flow of molten metal introduced into the refining hearth through the entry flow channel flows tangentially to the wall of the refining hearth and parallel to the base plane; and an exit flow channel through and tangential to the wall of the refining hearth, the exit flow channel lying parallel to the base plane.

10. The apparatus of claim 9, further including a second refining hearth adjacent to the refining hearth, the second refining hearth having a second refining hearth entry flow channel disposed to receive a flow of molten metal from the exit flow channel of the refining hearth.

11. The apparatus of claim 10, wherein the second refining hearth has a second refining hearth exit flow channel, and wherein the apparatus further includes a third refining hearth adjacent the second refining hearth, the third refining hearth having a third refining hearth entry flow channel disposed to receive a flow of molten metal from the second refining hearth exit flow channel.

12. The apparatus of claim 9, wherein the entry flow channel is an aperture through the refining hearth wall.

13. The apparatus of claim 9, wherein the entry flow channel has channel sides and a channel bottom defined by the wall of the refining hearth, but no top.

14. The apparatus of claim 9, wherein the refining hearth is substantially circular when viewed in a plan view.

15. The apparatus of claim 9, further including a second refining hearth adjacent to the refining hearth, the second refining hearth having a second refining hearth entry flow channel disposed to receive a flow of molten metal from the exit flow channel of the refining hearth.

16. The apparatus of claim 15, wherein the second refining hearth has a second refining hearth exit flow channel, and wherein the apparatus further includes a third refining hearth adjacent to the second refining hearth, the third refining hearth having a third refining hearth entry flow channel disposed to receive a flow of molten metal from the second exit flow channel of the second refining hearth.

17. The apparatus of claim 9, further including means for heating the molten metal in the refining hearth.

* * * * *